US005179752A

United States Patent [19]

Clough et al.

[11] Patent Number: 5,179,752

[45] Date of Patent: Jan. 19, 1993

[54] COVER FOR TRENCHES

[75] Inventors: Peter S. Clough, Stretford; Richard J. Yeowart, Aylesbury; Mansel Moore, Rutland, all of United Kingdom

[73] Assignee: British Gas plc, United Kingdom

[21] Appl. No.: 884,059

[22] Filed: May 14, 1992

Related U.S. Application Data

[63] Continuation of Ser. No. 619,836, Nov. 30, 1990.

[30] Foreign Application Priority Data

Dec. 4, 1989 [GB] United Kingdom ..... 8927346

[51] Int. Cl.[5] ..... E01D 19/12

[52] U.S. Cl. ..... 14/73; 14/74

[58] Field of Search ..... 14/73, 73.1, 74, 78

[56] References Cited

U.S. PATENT DOCUMENTS

| | | | |
|---|---|---|---|
| 2,308,943 | 1/1943 | Tietig et al. | 14/73 |
| 2,907,417 | 10/1959 | Doerr | 14/73 X |
| 3,859,000 | 1/1975 | Webster | 14/73 X |
| 3,956,788 | 5/1976 | Nagin | 14/73 |
| 4,953,249 | 9/1990 | Warwick | 14/74 X |
| 4,972,537 | 11/1990 | Slaw, Sr. | 14/1 |

*Primary Examiner*—William P. Neuder

*Attorney, Agent, or Firm*—Larson & Taylor

[57] ABSTRACT

A cover (1) for temporarily covering a trench, e.g. in a thoroughfare such as a road or footpath, by extending over, and resting on the ground on opposite sides respectively of the trench, the cover (1) being releasably engageable with other adjacent covers (1*a* and 1*b*) by means of male members (5 and 5*b*) mating with respective corresponding female members (6*a* and 6) in such a manner that when the covers (1, 1*a* and 1*b*) are engaged in a ground resting position to form an assembly (7) of covers, one cover (1*b*) of the assembly can be disengaged from the adjacent cover (1) only by moving the cover (1*b*) out of the general plane of the assembly.

13 Claims, 3 Drawing Sheets

COVER FOR TRENCHES

Figure 1:
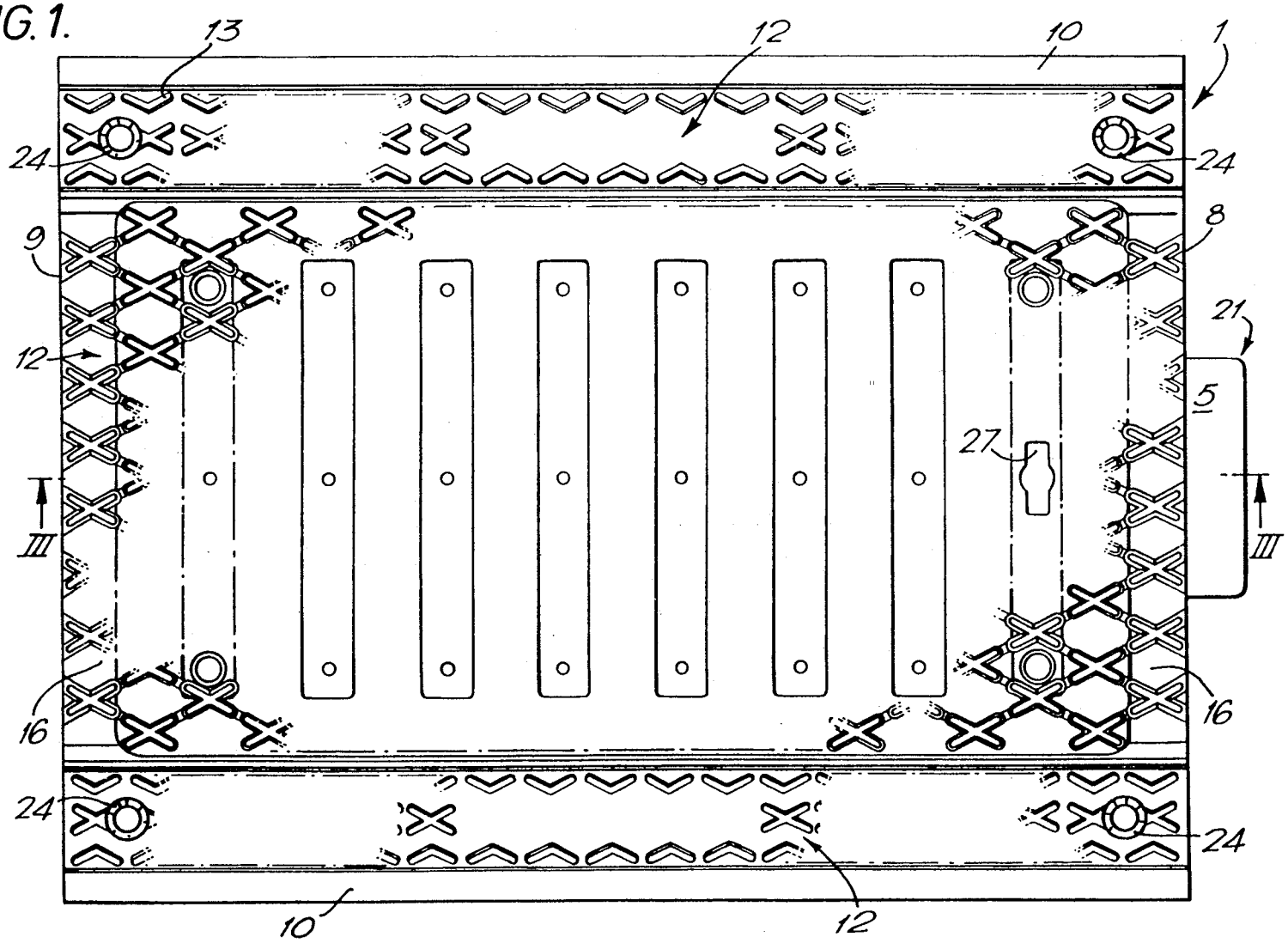

This application is a continuation of application Ser. No. 07/619,836, filed Nov. 30, 1990.

This invention relates to a cover for temporarily covering a trench in a thoroughfare such as a road or footpath, e.g. overnight until work restarts.

It is important that temporary trench covers can be laid and removed quickly and easily for re-use. Trench covers are already in use which consist in elongate plates, usually of steel, which are laid over the trench with the covers being supported by the ground on opposite sides of the trench. Normally a number of such plate covers are used, with the oppositely facing ends being in abutment. The problem with such plate covers is that, even though they are relatively heavy they can be moved lengthwise and transversely of the trench by vibration imparted by the movement of traffic (vehicles or people) over the plate covers which can result in dangerous gaps occurring therebetween and consequentially the possibility of accidents. If the transverse movements are too great there is the risk that one or more plate covers will be tipped into the trench. In order to minimise these movements, the work persons can either inset the covers in the road or path surface or use rubble or asphalt to provide stops. Even when such precautions are taken, these plate covers can still be worked loose, e.g. by heavy vehicular traffic.

Permanent covers for trench drains are known from U.S. Patent Specification No. Re. 26,366. Such covers are in the form of grates to allow water to pass therethrough into the drain and are inset into the top of the drain wherein they rest on metal framing to be flush with the surrounding drained area. Each cover comprises several individual grates which are arranged side by side lengthwise of the drain with one end of each grate being supported on the metal framing by an outwardly projecting lip and with the other end of each grate being supported by means of two lateral lugs extending from opposite sides respectively of each grate and engaging in correspondingly shaped notches of each two adjacent grates, with the lugs and notches lying within the general plane of the grates. At each end of the cover, a respective lateral lug engages on the framing to support the ends of the cover. Assembly and disassembly is by longitudinal movement into lug and notch engaging and disengaging positions. A removable key grate without lugs and notches is used to lock the whole assembly in position. Without the framing and key grate the individual gates would move lengthwise, thus making this cover unsuitable for a temporary trench cover as it would suffer from the same disadvantages of the known trench covers.

The same applies to the permanent floor covers described in the specification of U.S. Pat. No. 1,334,222 which relates to an interlocked parquet flooring system that is assembled by means of longitudinal interlocking movement. If an assembly of individual blocks were used without the surrounding strip as a temporary cover for a trench, then longitudinal vibration engendered movements could occur between the individual blocks.

The main object of the present invention is to provide a cover for temporarily covering a trench and in which the aforesaid disadvantages are minimized or avoided.

To this end and from one aspect the present invention consists in a cover for temporarily covering a trench, e.g. in a thoroughfare such as a road or a footpath, by extending over, and resting on the ground on opposite sides respectively of, the trench, the cover being releasably engageable with another adjacent cover in such a manner that when the covers are engaged in a ground resting position to form an assembly of covers, one cover of the assembly can be disengaged from an adjacent cover only by moving a cover out of the general plane of the assembly.

By means of the invention, once several interengaged covers are in the assembled position over a trench, lengthwise movement of the covers relatively to each other is minimised and therefore longitudinal release is avoided.

Thus, the problem of vibration engendered dangerous gapping between the ends of adjacent conventional covers can be prevented. Naturally, the nature of the releasable engagement is such that some lengthwise relative movement can occur between the adjacent covers in the assembly.

Advantageously, the releasable engagement also prevents or minimises vibration engendered lateral movements occuring between adjacent covers of the assembly.

In order to prevent a cover assembly from falling into a trench, by the movement of the traffic causing one side to tip into the trench, and to provide for greater versatility in use, the releasable engagement means is preferably of sufficient width that, no matter how far the cover assembly is pushed in any one lateral direction, the side of the releasable engagement on one side of the trench will abut against the trench wall on that side before the opposite side of the cover assembly is pushed clear of the adjacent wall of the trench on that opposite side. Of course, this means, as some trenches will be wider than others, that the width of the cover must be suitable for the particular width of the trench.

In other words, the distance between the lateral edge of the cover and the wall of the trench on one side should be chosen to be greater than the distance between the wall of the trench and the releasable engagement on the other side.

Whilst in the invention defined above, any cover, i.e. an intermediate or end cover, can be picked up to release it from adjacent covers, preferably to improve security for example, the nature of the releasable engagement is such that one cover can only be disengaged from the adjacent cover by picking up a cover at a free end of the assembly, it being impossible to remove a cover from an intermediate position in the assembly.

Accordingly, from another aspect, the present invention consists in a cover for temporarily covering a trench by extending over, and resting on the ground on opposite sides respectively of, the trench, said cover including a cover member provided with releasable engagement means comprising male and female latching members depending from opposite end regions respectively of the cover member.

Preferably the male latching member is a hook-shaped lug which mates with a female latching member in the form of an apertured lug on an adjacent cover. The aperture may be a slot or a laterally opening recess.

As will be appreciated, the height of the aperture is such that the free end of the hook can be passed through the aperture to latch or unlatch the hook shaped lug from the aperture of an apertured lug on an adjacent cover and is conveniently disposed so that a hook portion of the hooked shaped lug lies adjacent or touches the bottom of the aperture and abuts against an outer surface of the apertured lug.

In order to release an end cover from an adjacent cover, i.e. unlatch the hook-shaped lug from its enlatchment with an apertured lug of the adjacent cover, the cover member is provided with a key hole which can be engaged with a lifting hook to lift the end cover out of the general plane of the cover so that the free end of the hook-shaped lug can be pulled through the aperture in the apertured lug and the cover lifted away from the trench.

To enable a narrower width cover to be positioned over a slightly wider trench than usual, whilst still preventing a cover assembly from tipping into the trench, the apertured lug is preferably shaped laterally to receiver spacer elements to laterally extend the width of the lug. The lateral shaping may be recesses, e.g. in the form of grooves which receive tongues on the spacer elements.

The covers which are conveniently of rectangular shape may be made in a number of widths, e.g. 160 mm, 190 mm and 220 mm to cater for different widths of trench. Ideally the width of the cover should be no more than 40 mm greater than the width of the trench.

Whilst the length of the covers can be as desired, a suitable length is 500 mm.

The cover may be made of any suitable material, such as steel, consistent with providing the requisite strength to support heavy vehicles passing over it: but preferably in order to reduce weight and protect any metal from corrosion, e.g. steel from rusting, the whole cover including the cover member and the releasable engagement is made of metal reinforced plastics.

Thus, in a preferred embodiment the cover has a pressed-steel core or base around which the plastics material is moulded, with the cover member being preferably of corrugated shape to increase strength.

To facilitate the passage of traffic over the cover assembly, the cover advantageously has tapering lateral edges to form ramps, and optionally to increase grip, the cover is provided with a tread pattern on its top surface.

The tread pattern may have variations in depth.

Figure 2:
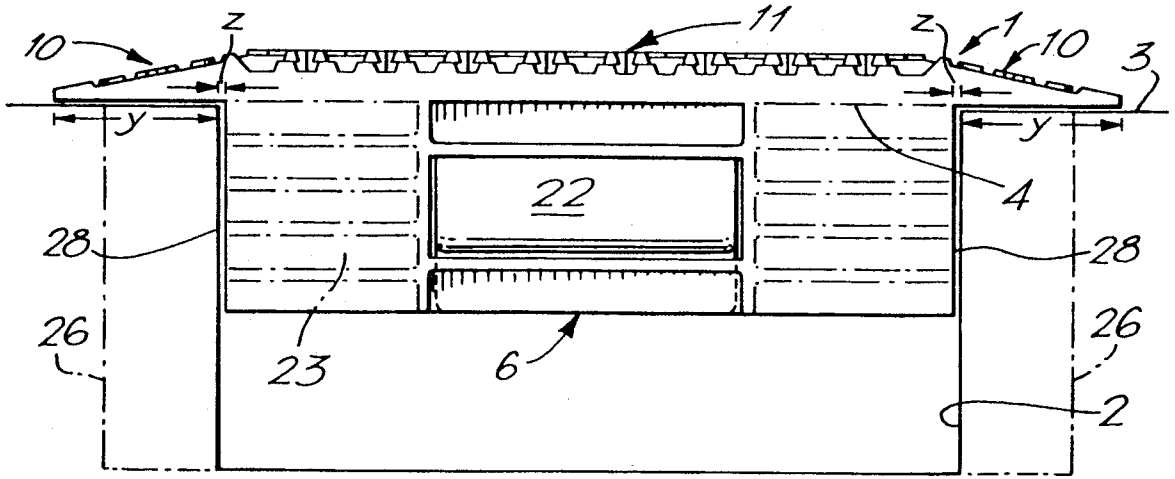
Figure 3:
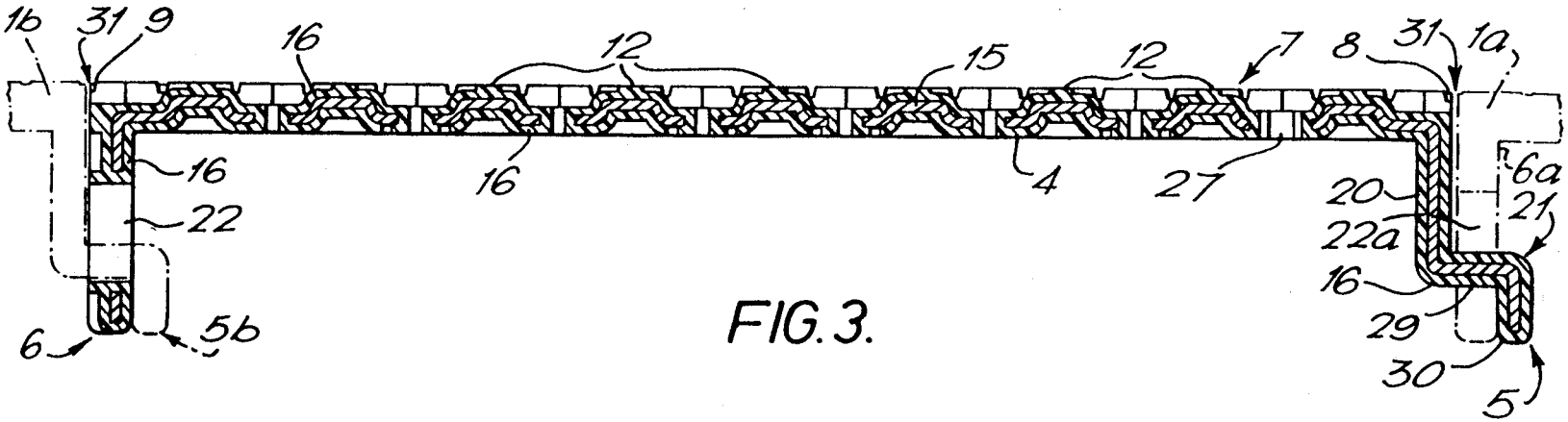
Figure 4:
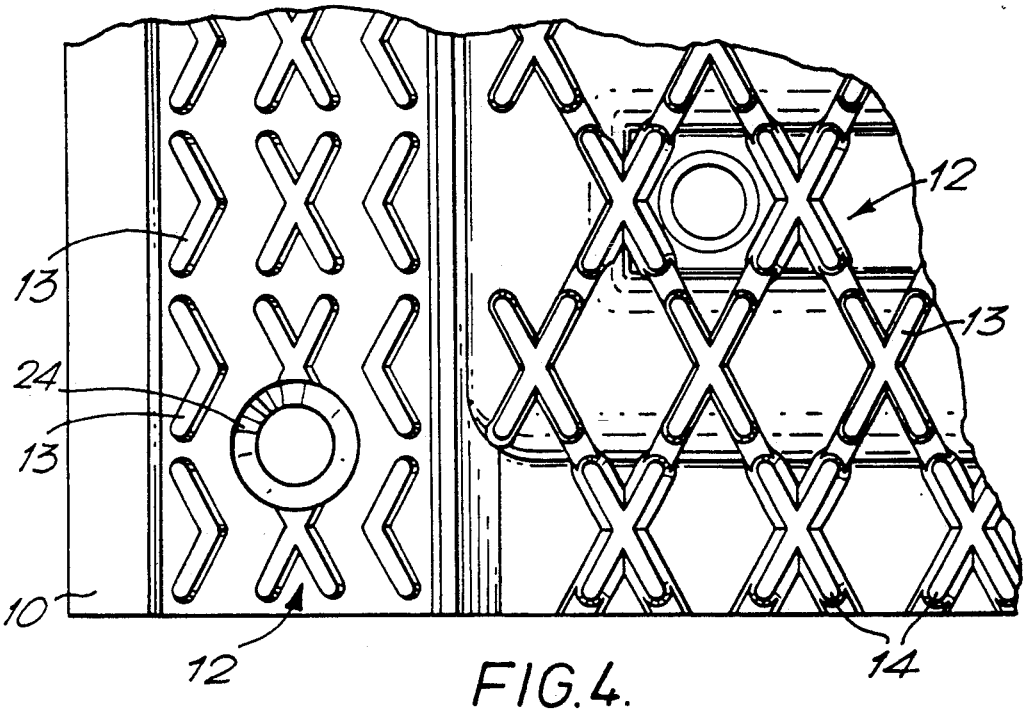
Figure 5:
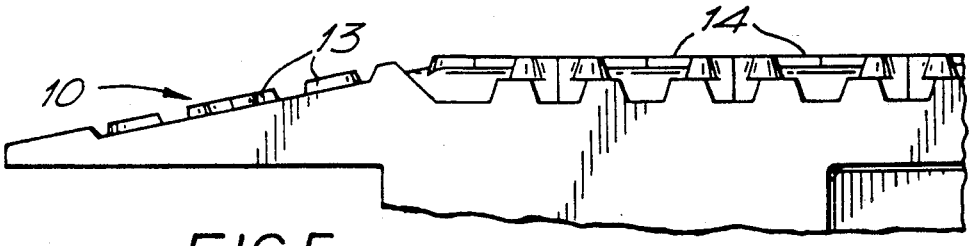
Figure 6:
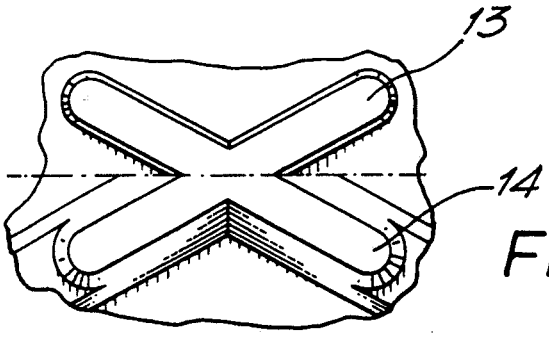

In order that the invention may be more readily understood, an embodiment thereof will now be described, by way of example, with reference to the accompanying drawings, in which:

FIG. 1 is a plan view of a cover for temporarily covering a trench, and made in accordance with the present invention, FIG. 2 is a left-hand end view, as illustrated, of the cover of FIG. 1, and positioned in a trench in a road, FIG. 3 is a longitudinal section taken along the line III—III of FIG. 1., FIG. 4 and 5 are detail plan and end views to an enlarged scale showing the surface tread pattern of the cover of FIG. 1, and FIG. 6 is another detail view illustrating variations in the depth of tread.

Referring to the drawings, there is shown a cover which is generally indicated at 1 for temporarily covering a trench 2 e.g. in a road 3, by a cover member 4 thereof extending over, and resting on the ground on opposite sides respectively of the trench. The cover 1 is releasably engageable with other adjacent covers 1*a* and 1*b*, partly shown in chain lines in FIG. 3, by means of male and female latching members in the form of hook-shaped and apertured lugs 5 and 6 respectively to form an assembly can be disengaged from an adjacent cover only by moving a cover out of the general plane of the assembly.

The lugs 5 and 6 (FIG. 3) depend from opposite end regions 8 and 9 respectively of the cover member 4. The cover member 4 has tapering lateral edges forming ramps 10 to facilitate the passage of traffic over the cover when in position covering a trench. To facilitate grip, the top surface of the cover member 4 including the ramps 10 and the area 11 lying between the ramps is provided with a tread pattern 12 which is at a minimum as indicated by the reference 13 and at a maximum, as indicated by the reference 14.

Referring more particularly to FIG. 3, the cover has a pressed steel base or core 15 extending throughout the cover member 4 and the lugs 5 and 6, with the base 15 in the region of the cover member 4 being corrugated to increase strength. Around the entire base 15 a plastics material 16 is moulded with the plastics material providing the ramps 10 and the tread pattern 12.

The hook-shaped lug 5 has a straight portion 20 depending perpendicularly from the end region 8 and a hook portion 21 projecting outwardly beyond the end region 8. Depending perpendicularly from the other end region 9 of the cover member 4 is the apertured lug 6 whose aperture is in the form of an elongate slot 22 extending transversely of the cover 1, as will be apparent from FIG. 2. The aperture 22 has a height such as to allow the cover 1 to be engaged with another such cover in a manner to be described. Moreover, on opposite sides respectively of the slot 22 the lug 6 has lateral recesses in the form of grooves 23 for receiving the tongues of at least one spacer element (not shown). The or each spacer element laterally would extend the width of the lug 6 to enable a narrower width cover to be positioned over a slightly wider trench than usual, as indicated by the chain lines 26 to avoid the cover from being tipped into the wider trench.

To faciliate lifting of the cover 1, a key hole 27 is provided in the cover member 4 adjacent the end region 8 with the hook-shaped lug 5, for use with a lifting hook (not shown).

In order temporarily to cover the trench 2 shown in the road 3 (see FIG. 2) the width of the covers 1 1*a* and 1*b* is chosen such that the distances (y) between the edge or wall of the trench and the edge of the cover on one side is greater than the distance (z), between the side 28 of the lug 6 and the edge or wall of the trench on the other side. If these distances are not right then one or two spacer elements not shown can be used. Then the cover 1 is brought to the trench and the end region 8 tilted downwards so that the hook portion 21 of the hook-shaped lug 5 can be passed through the aperture 22*a* in the lug 6*a*. The end region 9 of the cover 1 is lowered so that the horizontal part 29 of the hook portion touches, or lies close to the bottom of the aperture 22*a* and the vertical part 30 of the hook portion 21 abuts against the lug 6*a* beneath the aperture 22*a* to latch the two covers 1*a* and 1*b* together.

It will be appreciated from FIG. 3 that any attempt to remove the cover 1 from its engagement with the cover 1*a*, in a longitudinal direction, will be impossible. It is only by inserting the lifting hook in the keyhole 27 and lifting the vertical part 30 of the hook portion 21 of the lug 5 clear of the bottom of the aperture 22*a* that the hook portion can be released to permit the cover 1 to be unlatched and pulled clear of the cover 1*a*. This release or unlatching action as well as the latching action is permitted by the aperture 22*a* being of sufficient height.

The last cover 1*b* having a hook-shaped lug 5*b* which mates with the aperture 22 of the cover 1 is then latched to the cover 1 in a similar manner to that described for covers 1 and 1*a*, to complete the cover assembly 7 for covering the trench 2. The nature of the interengaging lugs is such that only small non-dangerous gaps 31 are left between the adjacent ends of the covers. It will be apparent from FIG. 3 that the intermediate cover cannot be moved in view of the enlatchment of the lugs 5, 6*a* and 5*b*, 66. It is only possible to remove the covers from one end of the assembly, that being the end in which an apertured lug is at the end of the cover assembly, in this case apertured lug (not shown) of the cover 1*b*. Thus the cover 1*b* is unlatched from the cover 1 in the same manner as the cover 1 was unlatched from the cover 1*a*.

Although a particular embodiment has been described it should be appreciated that modifications and variations may be made which do not depart from the scope of the invention. For example, instead of the cover being of oblong shape, it could be square. Also, the shape of the mating lugs 5 and 6 could be varied, for example, by having an upwardly facing hook-shaped lug constituting the female member which depends from, and projects beyond, one end region of the cover, and of which the hook is engageable by a plate-shaped lug, constituting the male member, depending from the other end region of another such cover. The upwardly facing hook-shaped lug could be of channel form with the plate-shaped lug engaging in the channel or the upwardly facing hook-shaped lug could have an aperture, e.g. a slot, in which the plate shaped lug engages.

We claim:

1. A cover for temporarily covering a trench comprising a cover member, said cover member having a central portion and, at each of two opposite sides thereof, respective lateral edge portions each extending along the length of the cover member and each having a lateral edge extending along a side thereof remote from said central portion, said cover having first and second opposite ends each extending transversely to said lateral edge portions and extending across the cover from one said lateral edge to said other lateral edge, a first lug depending from said first end and having a width dimension along the transverse direction of said cover at said first end such that said first lug has two spaced depending opposite edges each set back towards the middle of said first end from a proximate said lateral edge, a second lug depending from said second end and having a width dimension along the transverse direction of said cover less than the transverse dimension of said cover at said second end such that said second lug has two spaced depending edges each set back towards the middle of said second end from a proximate said lateral edge, said set back edges allowing the cover, in use, to be placed over a trench having a width at least equal to the width dimension of said second lug but less than the transverse dimension of the cover from one lateral edge to the other lateral edge so that the first and second lugs both extend into said trench and allow said lateral edge portions to rest on the ground on opposite sides respectively of the trench over which said cover extends, said first lug providing a male latching member, said second lug having an aperture therethrough and providing a female latching member such that said male latching member on a said cover can be fitted removably into the aperture of the female latching member of another said cover adjacent thereto and engage that female latching member when fitted into the aperture thereof, and said cover being releasably engageable by means of the male latching member of said cover engaging the female latching member of an adjacent said cover in such a manner that when the covers have the lugs thereof in the trench and the lateral edge portions thereof resting on the ground to form an assembly of said cover and the adjacent cover, one said cover of the assembly can be disengaged from the other said cover by moving a said cover out of a general plane of the assembly.

2. A cover as claimed in claim 1, wherein releasable engagement between the said male latching member of one said cover and the said female latching member of an adjacent said cover is such that one said cover can only be disengaged from the adjacent said cover by picking up the said cover at a free end of the assembly, whereby any said cover occupying an intermediate position in the assembly cannot be removed.

3. A cover as claimed in claim 1, wherein the male latching member is a hooked-shape lug.

4. A cover as claimed in claim 3, wherein said aperture has a height such that a hook portion of said male latching member can be passed through the aperture to latch or unlatch the male latching member to or from the female latching member on an adjacent said cover.

5. A cover as claimed in claim 4, wherein the hook portion of the male latching member, in use, lies adjacent or touches the bottom of the aperture of the female latching member of an adjacent said cover and abuts against an outer surface of the female latching member of an adjacent said cover when the cover is engaged therewith.

6. A cover as claimed in claim 1, and provided with a key hole adapted to be engaged with a lifting hook to disengage the cover from an adjacent cover.

7. A cover as claimed in claim 1, wherein the cover is made of metal reinforced plastic.

8. A cover as claimed in claim 7, wherein said metal reinforced plastic comprises a metal reinforcement comprising a pressed-steel base around which plastic is molded.

9. A cover as claimed in claim 1, wherein the lateral edge portions are tapered to form ramps.

10. A cover as claimed in claim 1, wherein the cover includes a top surface provided with a tread pattern.

11. A cover as claimed in claim 10, wherein the tread pattern has variations in depth.

12. A cover as claimed in claim 1, wherein the cover is mounted over a trench, and wherein a distance between a said lateral edge of the cover and an adjacent wall of the trench is greater than a distance between the opposite wall of the trench and an adjacent said set back edge of the female latching member.

13. A plurality of covers mounted over a trench to provide a temporary covering therefor, each said cover comprising a cover member, said cover member having a central portion and, at each of two opposite sides thereof, respective lateral edge portions each extending along the length of the cover member and each having a lateral edge extending along a side thereof remote from said central portion, said cover having first and second opposite ends each extending transversely to said lateral edge portions and extending across the cover from one said lateral edge to said other lateral edge, a first lug depending from said first end and having a width dimension along the transverse direction of said cover at said first end such that said first lug has two spaced depending opposite edges each set back towards the middle of said first end from a proximate said lateral edge, a second lug depending from said second end and having a width dimension along the transverse direction of said cover less than the transverse dimension of said cover at said second end such that said second lug has two spaced depending edges each set back towards the middle of said second end from a proximate said lateral edge, said set back edges allowing the cover, in use, to be placed over a trench having a width at least equal to the width dimension of said second lug but less than the transverse dimension of the cover from one lateral edge to the other lateral edge so that the first and second lugs both extend into said trench and allow said lateral edge portions to rest on the ground on opposite sides respectively of the trench over which said cover extends, said first lug providing a male latching member, said second lug having an aperture therethrough and providing a female latching member such that said male latching member on a said cover can be fitted removably into the aperture of the female latching member of another said cover adjacent thereto and engage that female latching member when fitted into the aperture thereof, and said cover being releasably engageable by means of the male latching member of said cover engaging the female latching member of an adjacent said cover in such a manner that when the covers have the lugs thereof in the trench and the lateral edge portions thereof resting on the ground to form an assembly of said cover and the adjacent cover, one said cover of the assembly can be disengaged from the other said cover by moving a said cover out of a general plate of the assembly, at least one said cover having its male latching member interengaged with the female latching member of an adjacent said cover.

* * * * *